US005702100A

United States Patent [19]

Novick et al.

[11] Patent Number: 5,702,100

[45] Date of Patent: Dec. 30, 1997

[54] MECHANISM FOR DIVERTING SIGNATURES BY THE ROTATION OF SURFACES

[75] Inventors: Michael Alexander Novick, New Durham; Roger Robert Belanger, Dover, both of N.H.

[73] Assignees: Heidelberg Harris, Dover, N.H.; Heidelberger Druckmaschinen AG, Heidelberg, Germany

[21] Appl. No.: 620,827

[22] Filed: Mar. 25, 1996

[51] Int. Cl.[6] ..... B65H 39/10

[52] U.S. Cl. ..... 271/302; 271/303; 271/187; 271/315

[58] Field of Search ..... 271/302, 303, 271/305, 315, 187

[56] References Cited

U.S. PATENT DOCUMENTS

| | | | |
|---|---|---|---|
| 4,120,491 | 10/1978 | Lang | 271/187 |
| 4,373,713 | 2/1983 | Loebach | 271/303 |
| 4,729,282 | 3/1988 | Kasdorf | 271/303 |
| 4,948,112 | 8/1990 | Sato et al. | 270/60 |
| 5,112,033 | 5/1992 | Breton | 271/315 |

FOREIGN PATENT DOCUMENTS

| | | | |
|---|---|---|---|
| 0089407 | 9/1983 | European Pat. Off. | 271/303 |
| 0 254 037 A2 | 1/1988 | European Pat. Off. . | |
| 0 297 282 B1 | 1/1989 | European Pat. Off. . | |
| 0 297 283 B1 | 1/1989 | European Pat. Off. . | |
| 0147763 | 6/1988 | Japan | 271/303 |

*Primary Examiner*—H. Grant Skaggs
*Attorney, Agent, or Firm*—Kenyon & Kenyon

[57] ABSTRACT

A diverter mechanism for signatures in a folding apparatus is provided including a set of high-speed tapes (3) for conveying signatures in a conveying plane (1) toward delivery stations (12, 13). Rotating diverting elements (7.1, 7.2) are integrated into the path of the high speed tapes (3). Each of the diverting elements (7.1, 7.2) has at least two rotatably mounted guiding surfaces (10) that alter the diverting direction of signatures upon rotation of the diverting elements (7.1, 7.2).

20 Claims, 7 Drawing Sheets

Fig. 3.1
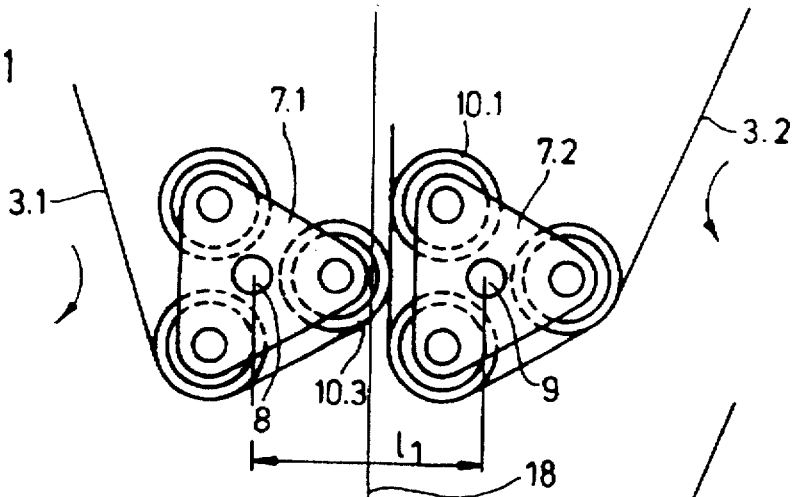
Fig. 3.2
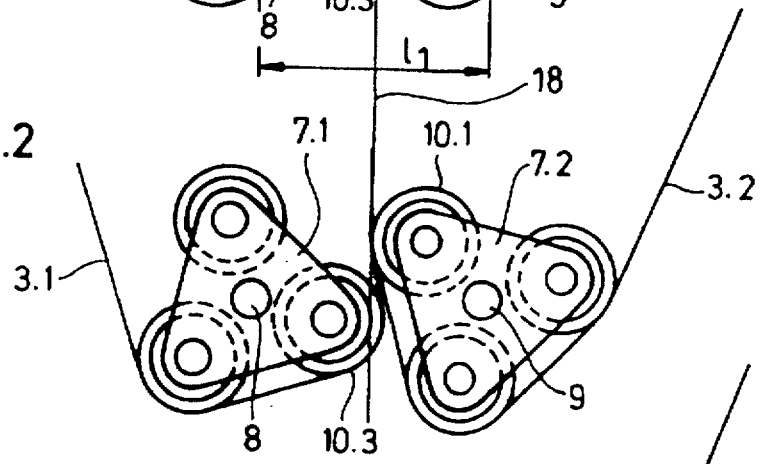
Fig. 3.3
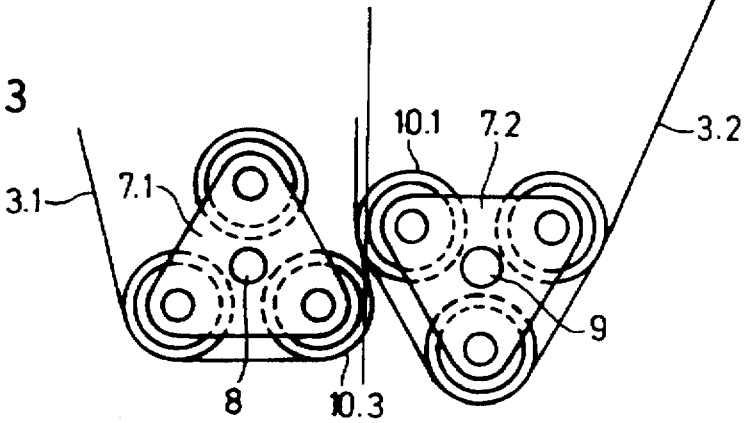
Fig. 3.4
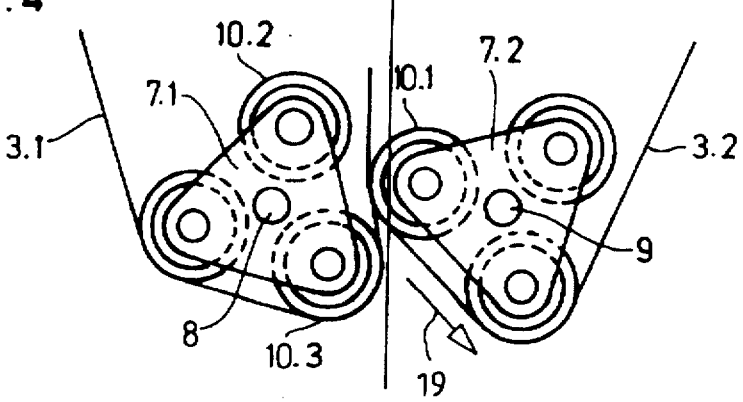

Fig. 3.5
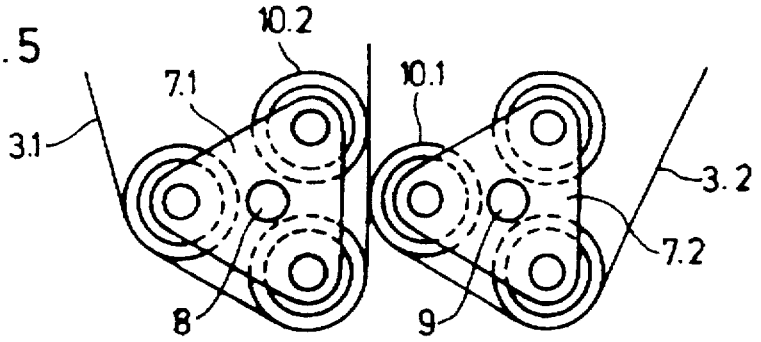
Fig. 3.6
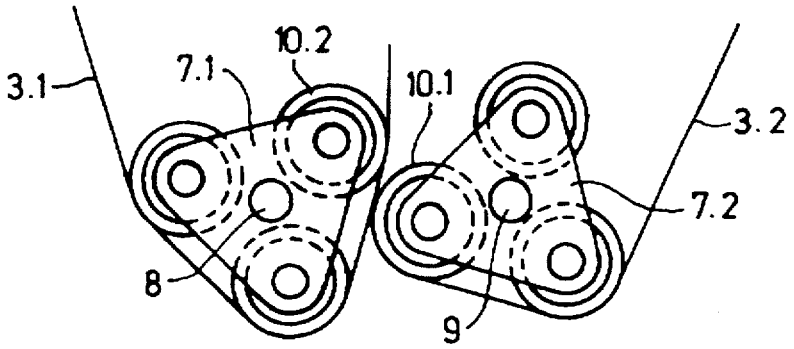
Fig. 3.7
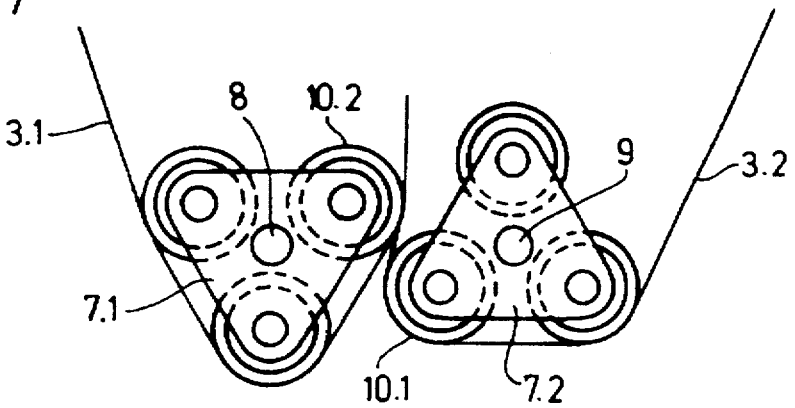
Fig. 3.8
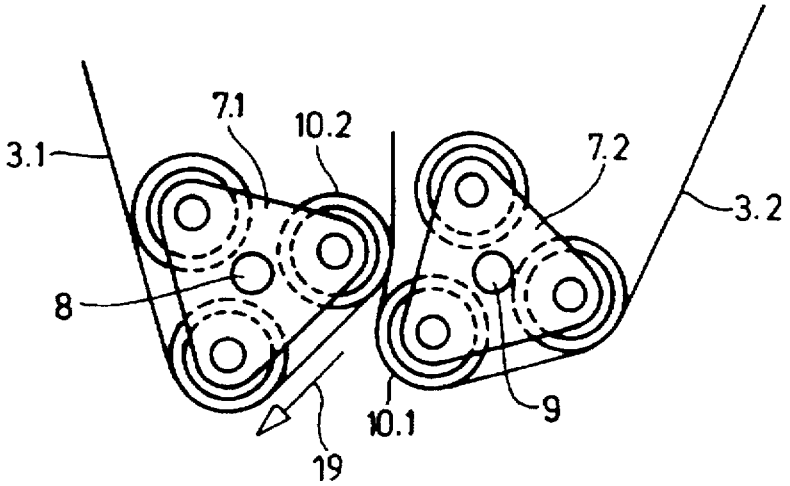

MECHANISM FOR DIVERTING SIGNATURES BY THE ROTATION OF SURFACES

FIELD OF THE INVENTION

The present invention relates to a mechanism for diverting signatures by the rotation of surfaces, especially within a folding apparatus assigned to a rotary printing press.

BACKGROUND OF THE INVENTION

EP 0 254 037 A2 purports to disclose a sheet diverter for signature collation and method thereof In a sheet diverter adapted for cooperative association with a cutter in a pinless folder assembly for a high-speed printing press, a ribbon is cut into a plurality of signatures destined for serially deflected parallel collation from a diverter path through the sheet diverter to a desired one of a plurality of collation paths to systematize the order of signatures in a selected array. An oscillating diverter guide member reciprocates in a diverter plane having a component which is generally normal to the diverter path of a signature through the guide member for directing the lateral disposition of the leading edge of the signature into engagement with a diverter member. A plurality of diverting paths, each has a throat for receiving a selected signature and merging to confined course for guiding it. The diverter member including a diversion surface disposed in each of the throats lying at a diversion angle respecting the travel of the signature from the oscillating guide member. The diverter member directs the leading edge of the signature and controls its course through the throat into a collation path.

EP 0 297 282 B1 and EP 0297 283 B1 each concern a device for subdividing a stream of prints. In EP 0 297 282 B1 two deflecting elements are placed against one another and rotating against one another. In particular, these deflecting elements are cylinders which force the prints into one of two subsequently arranged transport paths. The deflecting elements are formed by a pair of respectively similarly eccentrically rotating cutting cylinders to which a print carrier web is supplied. A print cut off between the cutting cylinder pair from the print carder web is then introduced into one of the transport paths.

EP 0 297 283 B1 purports to disclose two rotating deflection elements by means of which prints are forced into one of two transport paths situated downstream. The deflection elements are designed as wings which are different from each other, resilient and set against each other. They are arranged alternatingly on a pair of cutting cylinders to which a web is fed. The prints to be cut between the pair of cutting cylinders are introduced with the leading edge by one of the deflection elements into one of the transport paths.

U.S. Pat. No. 4,373,713 purports to disclose a diverter mechanism. A sheet diverter is disposed in the path of a stream of cut sheets to be diverted in predetermined sequence in different directions, in which a pair of rotary diverters having cam surfaces thereon divert and guide the sheets in their predetermined sequence relative to a pair of guiding surfaces.

The above-mentioned disclosures all require a steeple and corresponding secondary tape paths to forward diverted products to the respective predetermined delivery stations. EP 0 254 037 only allows for sinusoidal motion resulting in the tails of respective signatures ending on the wrong side of the steeple, thus, increasing the propensity for the signatures to be marked or damaged or to jam on the steeple.

SUMMARY OF THE INVENTION

In accordance with the present invention, a diverter mechanism for diverting signatures in a folding apparatus includes a set of high-speed tapes for conveying signatures in a conveying plane towards delivery stations. First and second rotating diverting elements are integrated into the path of the set of high-speed tapes. Each rotating diverting element has at least two rotatably mounted rotary guiding surfaces. By rotating the diverting elements, the diverting direction of signatures may be changed.

This configuration offers several advantages over the state of the art outlined above. For example, in accordance with the present invention, the requirement for a secondary transport belt system to convey signatures to fan wheels or the like is eliminated. Moreover, the present invention requires less space within the folding apparatus than prior art mechanisms. Another advantage of the present invention is that delivery of signatures into fan pockets can be tuned by a simple adjustment of opposing guiding surfaces of the rotating diverting elements.

In accordance with an embodiment of the present invention, the diverting elements include support members which rotate about respective axes. The guiding surfaces are rotatably mounted on the support members. The guiding surfaces can, for example, be formed as rollers extending over the entire width of the signature conveying plane or as a plurality of disc-shaped elements spaced over the width of the signature conveying plane, each disc having a thickness adapted to the width of the high-speed tape. The guiding surfaces contact the high speed tapes which in turn contact the signatures. The guiding surfaces do not directly contact the signatures.

The diverting elements can have two or more guiding surfaces. When diverting elements with two guiding surfaces are used, the guiding surfaces can be mounted side by side on the support members, e.g., 180 degrees offset from one another. If three or more guiding surfaces are used, they can be mounted on the support members in a planetary or satellite configuration, whereby the support member rotates about a central rotation point and the guiding surfaces are rotatably mounted to the support member at positions surrounding the central rotation point. Simultaneous rotation of the first and second diverting elements causes the guiding surfaces of the first diverting element to cooperate with the guiding surfaces of the second diverting element to divert signatures cyclicly right and left toward opposing delivery stations, such as a pair of fan wheels.

In a configuration in which each diverting element has two guiding surfaces, the support members of the diverting elements are oriented at an approximate 90° offset from each other. In this configuration, a guiding surface of one of the diverting elements encroaches a space between the two guiding surfaces of the other diverting element. The encroachment causes the high-speed tapes to become angularly offset from a centerline defined between the axes of the diverting elements, resulting in a deflection of signatures. For each 90° rotation of the diverting elements, the encroaching guiding surface changes from one side to the other thereby causing cyclic lateral movement of the high speed tape. This results in alternating right and left delivery of the signature. The signatures may be directed over a stationary guide member as in the prior art described above, or, alternatively, aimed directly into different delivery stations.

BRIEF DESCRIPTION OF THE DRAWINGS

FIGS. 1(*a, b*) show a side view of two embodiments of the guiding surface of the diverting elements.

FIG. 1(*c*) shows a more detailed view of the diverting element of FIGS. 1, 1(*b*).

FIG. 2(*b*) shows a diverting-with-aiming configuration in accordance with the present invention in which a pair of diverting elements diverts a signature angularly from the center line.

FIGS. 3.1 to 3.4 show a sequence of movements of the guiding surfaces to cause a signature's deflection to a first delivery station.

FIGS. 3.5 to 3.8 show a sequence of movements of the guiding surfaces to cause a signature's deflection to a second delivery station.

DETAILED DESCRIPTION OF THE INVENTION

Figure 1:
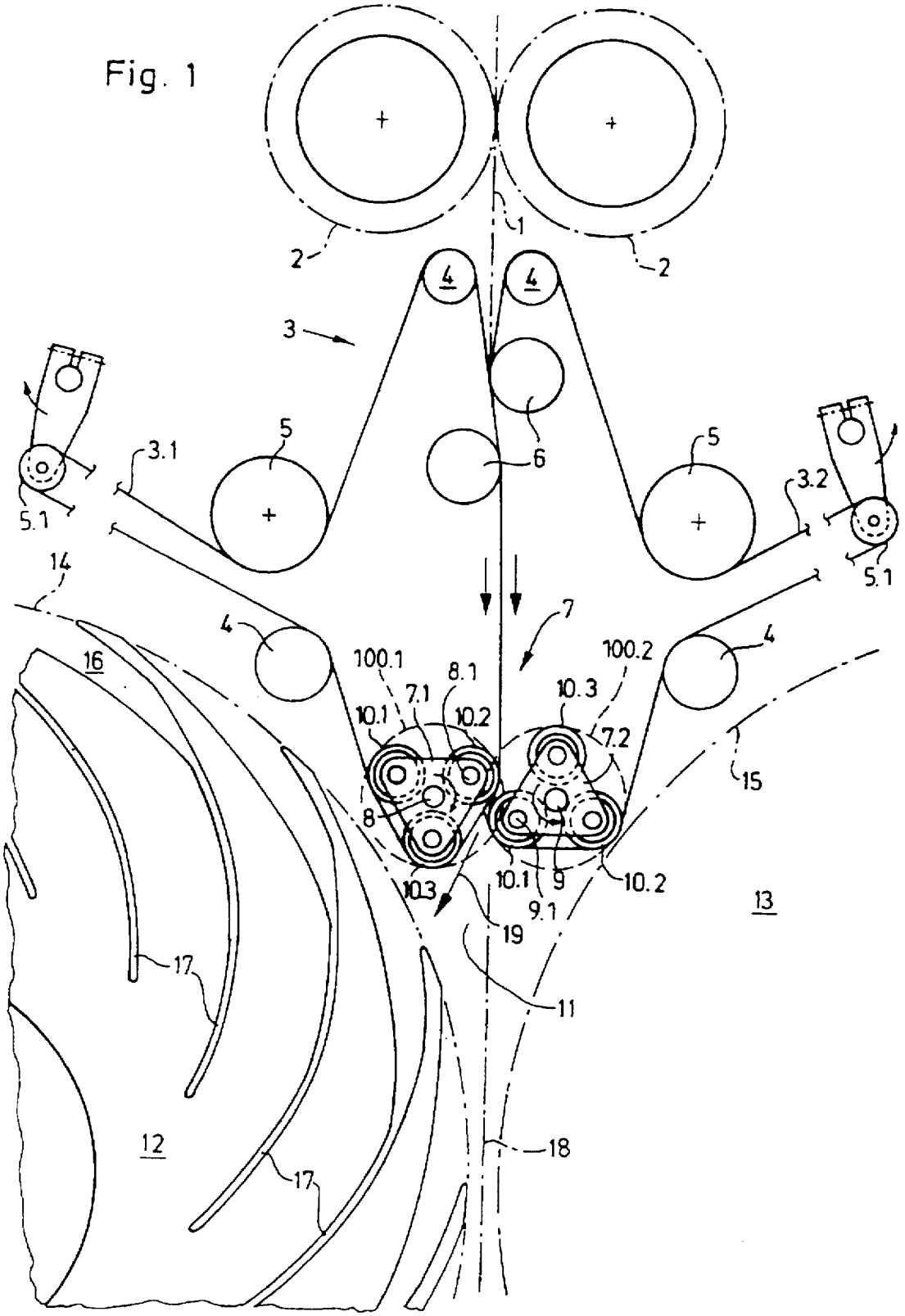
FIG. 1 is a front view of a diverter mechanism employing rotating diverting elements having three guiding surfaces.
Figure 1A:
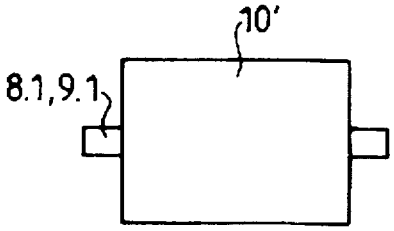
Figure 1B:
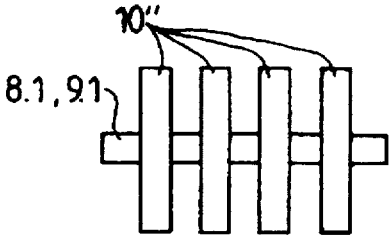
Figure 1C:
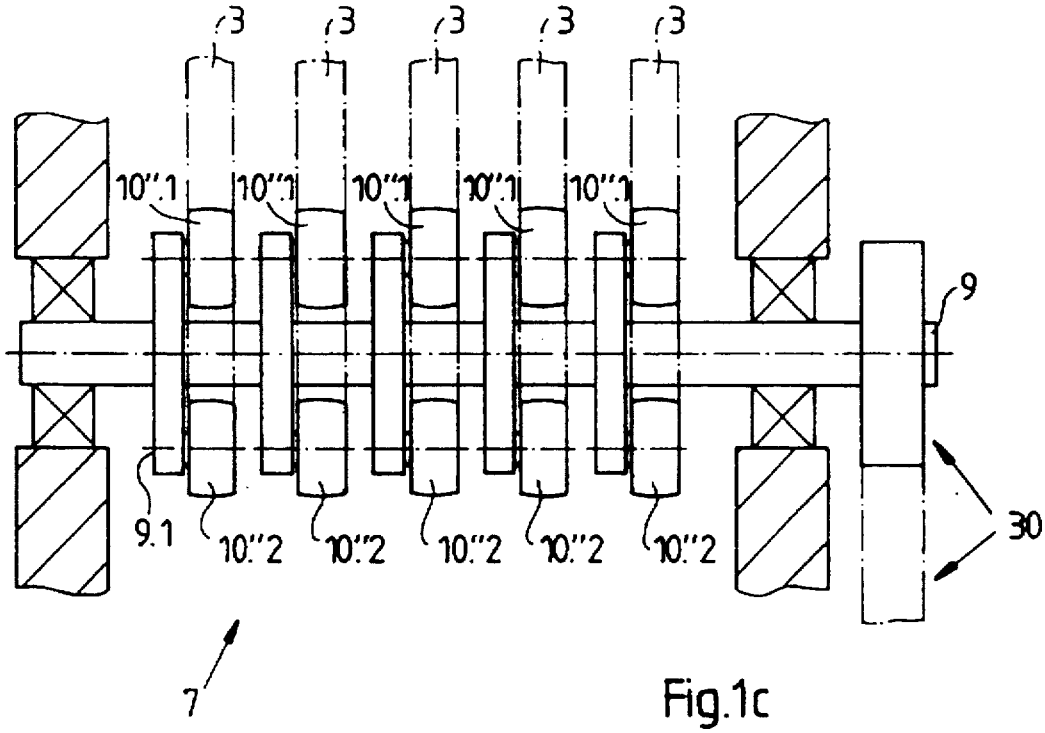

FIG. 1 shows a side view of a diverter mechanism according to a first embodiment of the present invention having satellite-like rotating diverting elements 7 integrated into a path of a set of high speed tapes 3.

A signature conveying path 1 extends from a pair of cutting cylinders 2 and between a set of high-speed tapes 3 which include a first high-speed tape 3.1 and a second high-speed tape 3.2. The high-speed tapes 3.1, 3.2, traverse a closed path around rollers 4, driving rollers 5, tensioning rollers 5.1, wrap rollers 6, and diverting elements 7. The diverting elements 7 include first and second diverting elements 7.1 and 7.2, assigned to the left and right high-speed tapes 3.1 and 3.2 respectively.

Diverting elements 7.1, 7.2 rotate about respective axes of rotation 8, 9. The diverting elements 7.1 and 7.2, shown with a triangular support member in FIG. 1, have several guiding surfaces 10 attached thereto. The guiding surfaces 10 include a first guiding surface 10.1, a second guiding surface 10.2 and a third guiding surface 10.3. The guiding surfaces of the diverting elements 7.1, 7.2 form overlapping circumferential envelopes 100.1, 100.2 about axes 8, 9. As shown in FIGS. 1(*a,b*), the guiding surfaces 10 can either be rollers 10' extending through the width of the signature conveying path 1 (FIG. 1(*a*)) or a plurality of individual disc-shaped roller elements 10" extending across the width of the signature conveying path 1.

By rotating in clockwise and counterclockwise directions as indicated by the arrows in FIG. 1, diverting elements 7.1 and 7.2 divert signatures cyclicly left and right toward opposing fan wheels 12 and 13. The diverting elements 7.1 and 7.2, are synchronized such that one guiding surface 10, that is, the first guiding surface 10.1, the second guiding surface 10.2, or the third guiding surface 10.3 of the first diverting element 7.1, cooperates with one of the corresponding surface elements 10 of the second diverting element 7.2. FIG. 1 shows the second surface 10.2 of the first diverting element 7.1 cooperating with the first guiding surface 10.1 of the second diverting element 7.2. For the position shown, a signature would be deflected as indicated by arrow 19 in the deflection area 11.

FIG. 1(*c*) shows a more detailed side view of a diverting element, indicated generally by reference numeral 7, for which the guiding surface 10 is composed of a plurality of disc-shaped roller elements 10". The diverting element 7 is rotated by a first drive 30. The first drive 30 may be of any known construction suitable for rotating the diverting element 7, e.g., gears, belts, or individually driven motors.

The driving rollers 5 drive the high speed tapes 3.1, 3.2. Preferably, the driving rollers 5 are driven by a second drive (not shown) which is independent from the first drive 30. By rotating the diverting elements 7.1, 7.2, via the first drive 30 independently of the high speed tape driving rollers 5, the diverting elements 7 can be used for any signature length. For example, for a given speed of the high speed tape driving roller 5, a shorter signature length would require a faster rotation of the diverting elements 7 to achieve proper delivery of the signature. Correspondingly, a longer signature, driven at the same speed by driving roller 5, would require a slower rotation of diverting elements 7 by drive 30 to achieve proper delivery. With independent drives for the high speed tape driving rollers 5 and the diverting elements 7, any arrangement of signature length and delivery frequency can be accommodated.

Referring to FIG. 1, the deflection area 11 is delimited by envelope curves 14, 15 of the fan wheels 12, 13, respectively. The fan wheels 12, 13 include a plurality of fan pockets 17 each having an entry region 16. The rotation of the fan wheels 12, 13 is phased so that a fan pocket entry region 16 is in rotational position to receive a signature at the instant the diverting elements 7 deflect the signature toward it. The diverting elements 7.1, 7.2 and the fan wheels 12 and 13 are synchronized so that succeeding signatures will be cyclicly deflected left and right toward fan pocket entry regions 16 of fan wheels 12 and 13, respectively. Reference numeral 18 indicates the centerline between fan wheels 12 and 13. Reference numeral 18 is also the centerline between the axes 8,9 of the diverting elements 7.1, 7.2. As will be explained in more detail below, the signature conveying path 1 will be set off angularly to the right and left sides of the centerline 18 by the diverting elements 7.

Figure 2A:
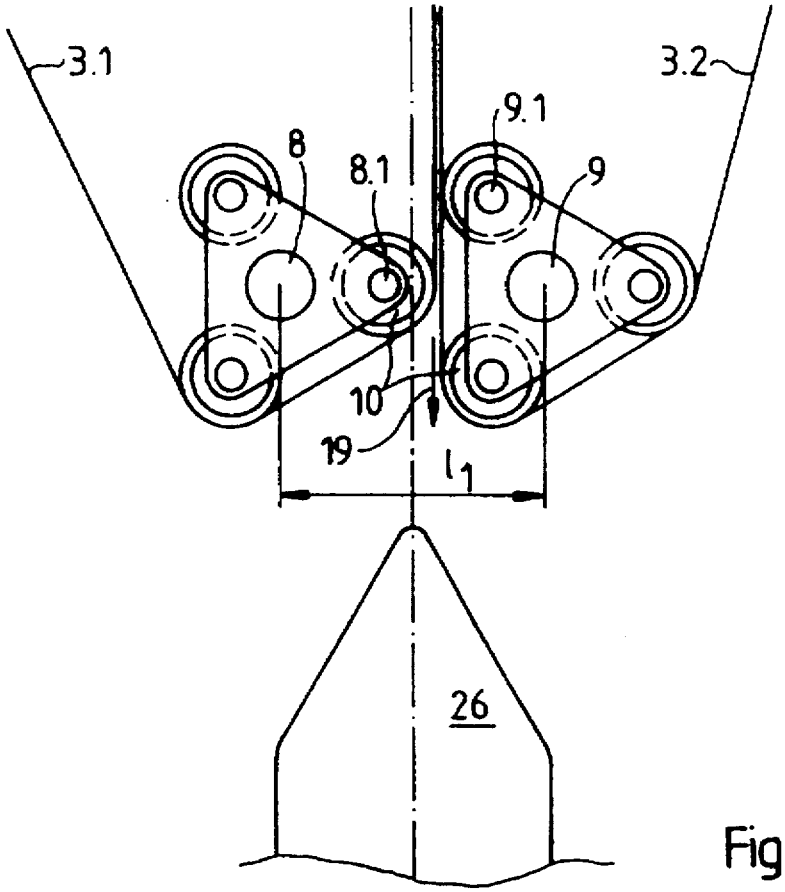
FIG. 2(*a*) shows a diverting-only configuration of the present invention in which a pair of diverting elements diverts a signature laterally from the center line.
Figure 2B:
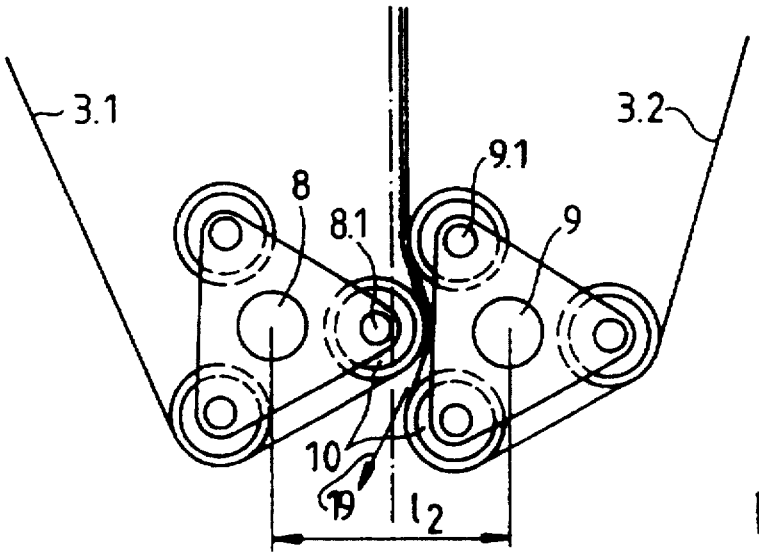

As shown in FIGS. 2(*a*) and 2(*b*), the diverters 7.1, 7.2 can be configured to accomplish either 'diverting-only' or 'diverting-with-aiming.' A diverting only configuration is shown in FIG. 2(*a*). The diverting elements 7.1 and 7.2 are shown with a distance $l_1$ between their respective axes of rotation 8 and 9. This arrangement offsets the high speed tapes 3.1, 3.2 laterally to the right or left of the centerline 18 without conforming the high speed tape path to the guiding surfaces. The result is that the signatures are diverted laterally to the right or left of the centerline 18. As shown,4 such a configuration can be used, for example, to divert a signature laterally to the right or left of the center line and to guide it over a steeple 26.

FIG. 2(*b*) shows a diverting with aiming configuration. The distance $l_2$ between the axes of rotation 8 and 9 is smaller than the distance $l_1$ shown in FIG. 2(*a*). In this configuration, the path of the high speed tapes 3.1, 3.2, rather than being merely offset from the centerline 18, is altered to conform to the surface of the guide surfaces 10. A signature emerging from the diverting elements as shown in the configuration of FIG. 2(*b*) will be angularly offset from the centerline 18 and aimed to the left as indicated by arrow 19. The degree of aiming can be varied by adjusting the size, spacing, and interferences of the diverting elements and its components.

Moreover, it is apparent that alternative embodiments are possible in which the distances $l_1$ and $l_2$ are equal, and diverting-only or diverting-with-aiming is achieved by changing the size of the diverting elements, the guiding surfaces, or the relative angular relationship between the diverting elements 7 during signature release.

For example, FIGS. 3.1 to 3.4 show a sequence of rotational movement of diverting elements 7.1, 7.2 of FIG. 1 in a diverting-with-aiming configuration. As illustrated in FIG. 3.1, the center distance is equal to $l_1$. Each diverting element 7.1, 7.2 has three guiding surfaces 10.1, 10.2 and 10.3. The diverting elements 7.1, 7.2, are wrapped by high-speed tapes 3.1 and 3.2, respectively. The second diverting element 7.2 rotates counterclockwise as indicated by the arrow on the right. The first diverting element 7.1 rotates clockwise. In FIGS. 3.1 to 3.4 the rotational movement of the diverting elements 7.1, 7.2 is shown in increments of about 15°.

In FIG. 3.2, the first guiding surface 10.1 of diverting element 7.2 and the third guiding surface 10.3 of diverting element 7.1 form a nip. Upon further rotation of the diverting elements 7.1, 7.2, the nip narrows according to FIGS. 3.2 and 3.3. In FIG. 3.4, a deflection of a signature emerging from the nip between the high-speed tapes 3.1 and 3.2 is achieved. The emerging signature is diverted angularly with respect to the centerline toward the right as indicated by arrow 19.

In FIGS. 3.5 to 3.8, guiding surface 10.1 of the second diverting element 7.2 is shown cooperating with guiding surface 10.2 of the first diverting element 7.1. The successive FIGS. 3.5 to 3.8 show rotational increments of approximately 15° of the diverting elements 7.1 and 7.2. As shown, the first guiding surface 10.1 moves into the second diverting element 7.2, thereby laterally offsetting the conveying plane of the signatures, diverting them in the direction indicated by the arrow 19 shown in FIG. 3.8. In general, FIGS. 3.1 to 3.4 show a rotational sequence of the diverting elements 7.1 and 7.2 resulting in signature deflection to the right, whereas FIGS. 3.5 to 3.8 show a rotational sequence resulting in signature deflection to the left.

As a result, by altering the relative angular relationship between the diverting elements 7 from FIG. 2(*a*), diverting-with-aiming is accomplished while maintaining the center distance at $l_1$.

Figure 4:
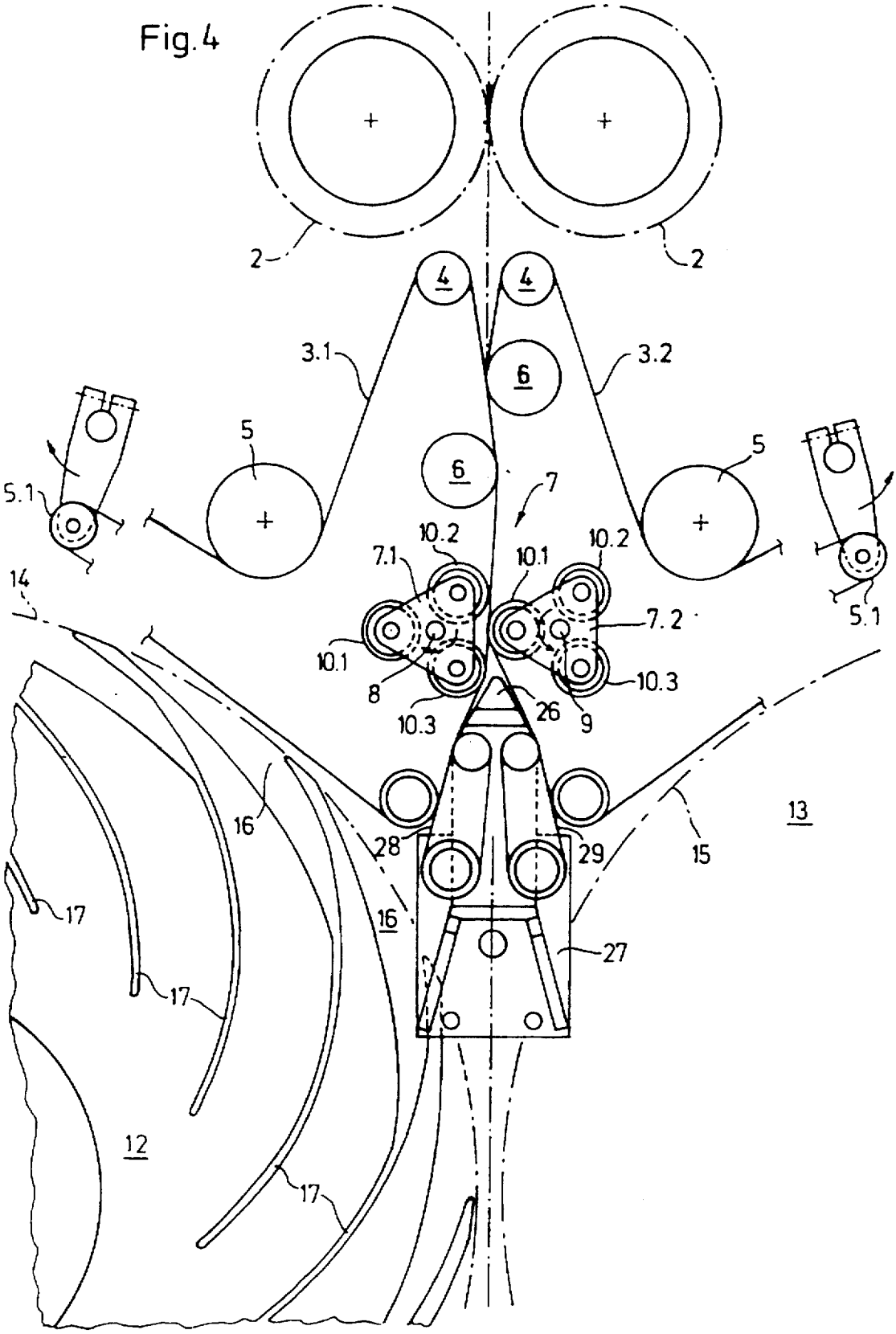
FIG. 4 is a front view of a diverter mechanism according to the present invention including a guide member.

FIG. 4 shows a second embodiment according to the present invention in which the diverting elements 7 are arranged in a diverting-only configuration. The high-speed tapes 3.1 and 3.2, are not completely wound around the outer circumference of the diverting elements 7.1, 7.2, but are arranged above a diverting unit 27 having a guide member 26. The diverting elements 7.1 and 7.2, each having a plurality of guiding surfaces 10.1, 10.2 and 10.3. The relative angular relationship between the diverting elements during signature delivery is the same as in FIGS. 2(*a,b*) and the center distance is equal to $l_1$. The diverting elements 7 cooperate to deflect the signatures laterally to one side of the guide member 26 or the other, depending on the rotational position of the diverting elements 7.1, 7.2. Thus, the signatures are either conveyed between the left high-speed tape 3.1 and its corresponding transport tape 28 or between the right high-speed tape 3.2 and its corresponding transport tape 29. The signatures enter fan pocket entry region 16 of either the left fan wheel 12 or the right fan wheel 13, as arranged below the diverting unit 27.

Figure 5:
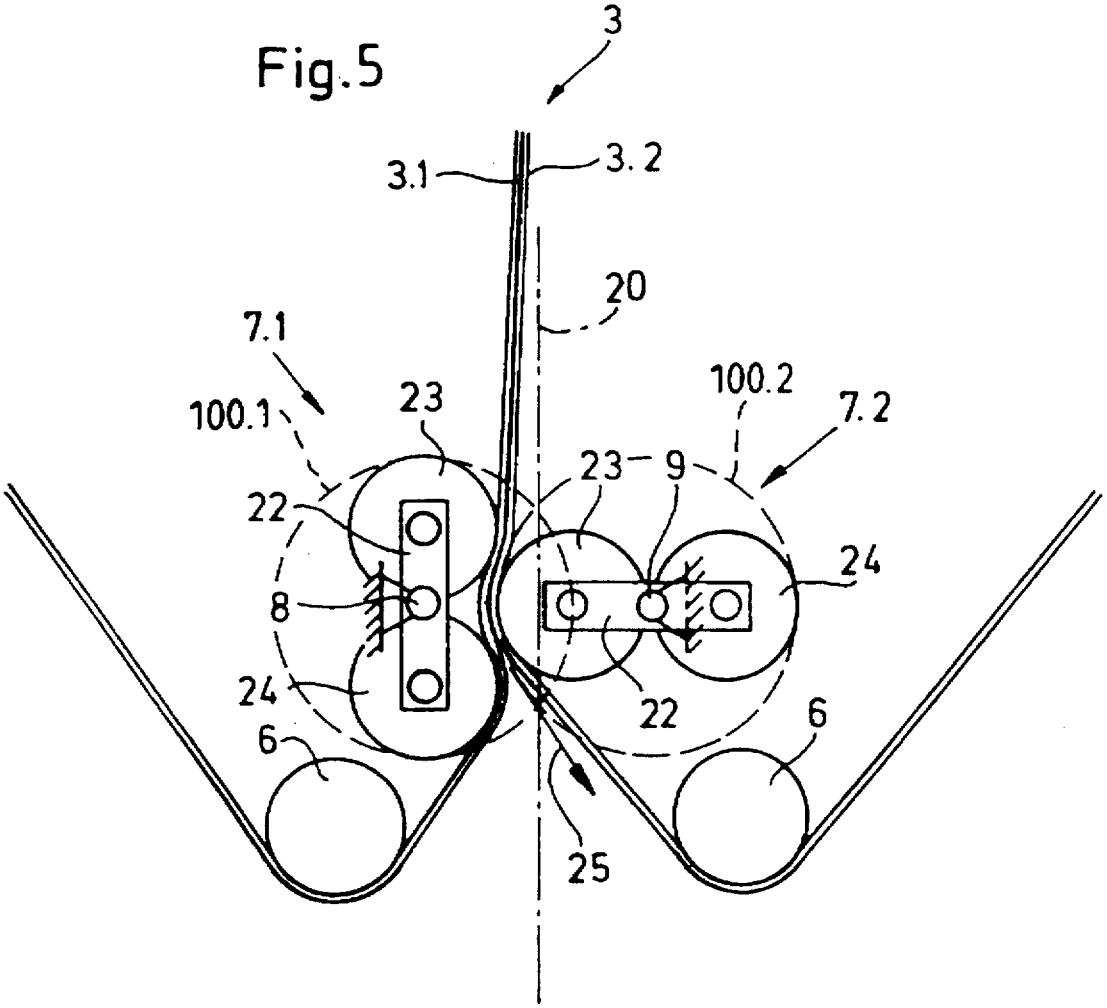
FIG. 5 is a from view of a diverter mechanism employing diverting elements having two guiding surfaces.

FIG. 5 shows another embodiment of the present invention. In this embodiment, the diverting elements 7.1 and 7.2 each have two guiding surfaces 23 and 24 respectively. The guiding surfaces 23, 24 of the diverting elements 7.1, 7.2 form overlapping circumferential envelopes 100.1, 100.2 about axes 8, 9. The guiding surfaces 23, 24 are supported by supports 21 and 22 which rotate about axes 8 and 9 respectively. The support 21 for the left guiding surfaces 23 rotates at the same angular velocity but with a 90° phase shift from the support 22 for the right guiding surfaces 24. When support 21 is vertical, support 22 is horizontal. After a 90° rotation, the orientation is reversed such that support 21 is horizontal and support 22 is vertical. As the supports 21, 22 rotate, the high-speed tapes 3.1 and 3.2 are angularly offset from the centerline 20 by the encroaching motion of the guiding surfaces 23, 24.

In the position shown in FIG. 5, a guiding surface 24 of the right diverting element 7.2 is encroaching the nip between the guiding surfaces 23 of the left diverting element 7.1. Consequently, a signature emerging from the cooperating high-speed tapes 3.1, 3.2 will be diverted angularly to the right of the centerline 20, as indicated by arrow 25.

A 90° rotation of the diverting elements 7.1 and 7.2 from the position shown in FIG. 2 results in the high-speed tapes 3.1 and 3.2 being angularly offset to the right of the centerline 20. One of the guiding surfaces 23 of the left diverting element 7.1 will encroach the nip between the guiding surfaces 24 of the right diverting element 7.2. Consequently, signatures emerging from the nip between the high-speed tapes 3.1, 3.2 will be diverted angularly to the left of the centerline 20.

What is claimed is:

1. A diverter mechanism for signatures in a folding apparatus comprising:

a first high-speed tape and a second high-speed tape, wherein adjacent portions of the first and second high-speed tapes form a signature conveying path for conveying the signatures toward a delivery station;

a first rotating diverting element adjacent to the first high-speed tape and a second rotating diverting element adjacent to the second high-speed tape, each of the first and second diverting elements having at least two guiding surfaces mounted thereto, wherein each of the guiding surfaces is mounted for rotation about a respective guiding surface axis, and wherein each of the guiding surface axes are separated from one another, wherein an orientation of the guiding surfaces of the first diverting element relative to an orientation of the guiding surfaces of the second diverting element defines a portion of the signature conveying path to control delivery of the signatures to a desired location within the delivery station.

2. The diverter mechanism according to claim 1, wherein the first diverting element includes a first support rotating about a first support axis, and wherein the second diverting element includes a second support rotating about a second support axis.

3. The diverter mechanism according to claim 2, wherein simultaneous rotation of the first and second diverting elements causes one of the at least two rotatably mounted guiding surfaces of the first diverting element to cooperate with one of the at least two rotatably mounted guiding surfaces of the second diverting element to divert each of the first and second high-speed tapes away from a centerline defined between the first and second support axes.

4. The diverter mechanism according to claim 3, wherein the at least two rotatably mounted guiding surfaces of the first diverting element are mounted on the first support in a planetary arrangement, and wherein the at least two rotatably mounted guiding surfaces of the second diverting element are mounted on the second support in a planetary arrangement.

5. The diverter mechanism according to claim 2, wherein the delivery station includes a first fan wheel and a second fan wheel, each one of the first and second fan wheels having a plurality of fan pockets for receiving signatures; and further including a drive for selectively driving the first and second diverting elements about the first and second support axes to alternate delivery of the signatures between the fan pockets of the first fan wheel and the fan pockets of the second fan wheel.

6. The diverter mechanism according to claim 5, wherein when the orientation of the first diverting element relative to the second diverting element is maintained constant signatures are continually diverted to one of the first fan wheel and the second fan wheel.

7. The diverter mechanism according to claim 2, wherein timing of a change of the orientation of the first and second diverting elements relative to one another is controlled based on the length of the signatures being conveyed.

8. The diverter mechanism according to claim 1, wherein the at least two rotatably mounted guiding surfaces of each of the first and second diverting elements contact the respective one of the first and second high-speed tapes.

9. The diverter mechanism according to claim 8, wherein each of the first and second high speed tapes includes respective signature-contacting and signature-non-contacting surfaces, and wherein contact between the guiding surfaces and each one of the first and second high-speed tapes occurs on the signature-non-contacting surfaces of the respective one of the first and second high speed tapes.

10. The diverter mechanism according to claim 1, wherein the first and second diverting elements are located on opposite sides of a centerline, and wherein the at least two rotatably mounted guiding surfaces of each of the first and second diverting elements divert the signature conveying path laterally with respect to the centerline.

11. The diverter mechanism according to claim 1, wherein the at least two rotatably mounted guiding surfaces of one of the first and second diverting elements cooperate with the at least two rotatably mounted guiding surfaces of the other one of the first and second diverting elements to direct the signatures over a guide member.

12. The diverter mechanism according to claim 1, wherein the delivery station includes a pair of fan wheels, and wherein the orientation of the guiding surfaces of the first diverting element with respect to the orientation of the guiding surfaces of the second diverting element defines the signature delivery path so that the signatures are delivered to a selected one of the fan wheels.

13. The diverter mechanism for signatures in a folding apparatus, comprising:

a first high-speed tape forming a first closed path and a second high-speed tape forming a second closed path, the first and second high-speed tapes for conveying the signatures in a signature conveying plane toward a delivery station;

a first rotating diverting element adjacent to and inside of the first closed loop path and a second rotating diverting element adjacent to and inside of the second closed loop path, each one of the first and second diverting elements having at least two rotatably mounted guiding surfaces mounted thereto;

wherein the first diverting element includes a first support rotating about a first support axis, and wherein the second diverting element includes a second support rotating about a second support axis;

wherein the first support has a first end and a second end, and wherein the at least two rotatably mounted guiding surfaces of the first diverting element include a first guiding surface mounted on the first end of the first support and a second guiding surface mounted on the second end of the first support, the first guiding surface being 180 degrees offset from the second guiding surface, and wherein the second support has a first end and a second end, and wherein the at least two rotatably mounted guiding surfaces of the second diverting element include a third guiding surface mounted on the first end of the second support and a fourth guiding surface mounted on the second end of the second support, the third guiding surface being 180 degrees offset from the fourth guiding surface, and wherein a first plane defined between the first and second guiding surfaces is 90 degrees offset from a second plane defined between the third and fourth guiding surfaces.

14. The diverter mechanism according to claim 13, wherein simultaneous rotation of each of the first and second diverting elements causes one of the at least two rotatably mounted guiding surfaces of the first diverting element to encroach a space between the at least two rotatably mounted guiding surfaces of the second diverting element to divert each of the first and second high-speed tapes away from a centerline defined between the first and second support axes.

15. A diverter mechanism, for signatures in a folding apparatus, comprising:

a first high-speed tape forming a first closed path and a second high-speed tape forming a second closed path, the first and second high-speed tapes for conveying the signatures in a signature conveying plane toward a delivery station;

a first rotating diverting element adjacent to and inside of the first closed loop path and a second rotating diverting element adjacent to and inside of the second closed loop path, each one of the first and second diverting elements having at least two rotatably mounted guiding surfaces mounted thereto;

wherein the first diverting element includes a first support rotating about a first support axis, and wherein the second diverting element includes a second support rotating about a second support axis wherein the at least two rotatably mounted guiding surfaces of the first diverting element are mounted on the first support in a planetary arrangement, and wherein the at least two rotatably mounted guiding surfaces of the second diverting element are mounted on the second support in a planetary arrangement, and wherein simultaneous rotation of each of the first and second diverting elements causes one of the at least two rotatably mounted guiding surfaces of the first diverting element to encroach a space between the at least two rotatably mounted guiding surfaces of the second diverting element to divert each of the first and second high-speed tapes away from a centerline defined between the first and second support axes.

16. A diverter mechanism for selectively diverting signatures towards different delivery stations, comprising:

a first high speed tape;

a second high speed tape cooperating with the first high-speed tape to form a signature conveying path for transporting signatures;

a first rotating diverting element adjacent to the first high-speed tape and a second rotating diverting element adjacent to the second high-speed tape, each of said first and second diverting elements having at least two rotatably mounted guiding surfaces mounted thereto, so that each of the rotatably mounted guiding surfaces rotates about a respective guiding surface axis which is separated from each of the guiding surface axes of the other guiding surfaces; and a drive for selectively rotating the first and second rotating diverting elements to control the signature conveying path so that the signatures are diverted to one of a pair of delivery stations.

17. The diverting mechanism according to claim 16, wherein the first rotating diverting element includes a first pair of guiding surfaces mounted for rotation about a first support axis, and the second rotating diverting element includes a second pair of guiding surfaces mounted for rotation about a second support axis.

18. The diverting mechanism according to claim 17, wherein the first pair of guiding surfaces form a first circumferential envelope as they rotate about the first axis, and the second pair of guiding surfaces form a second circumferential envelope as they rotate about the second axis, the first and second circumferential envelopes partially overlapping each other.

19. The diverting mechanism according to claim 16, wherein the first rotating diverting element includes three guiding surfaces mounted in a planetary arrangement for rotation about a first support axis, and the second rotating diverting element includes three guiding surfaces mounted in a planetary arrangement for rotation about a second support axis.

20. The diverting mechanism according to claim 19, wherein the three guiding surfaces of the first diverting element form a first circumferential envelope as they rotate about the first support axis, and the three guiding surfaces of the second diverting element form a second circumferential envelope as they rotate about the second support axis, the first and second circumferential envelopes partially overlapping each other.

* * * * *